US005466064A

United States Patent [19]

Hudson

[11] Patent Number: 5,466,064

[45] Date of Patent: Nov. 14, 1995

[54] FUEL HOMOGENIZATION SYSTEM WITH DUAL COMPENSATING HOMOGENIZATION VALVES

[75] Inventor: Dannie B. Hudson, Jacksonville, Fla.

[73] Assignee: ENRJ Ltd., Grand Bahama, Bahamas

[21] Appl. No.: 447,792

[22] Filed: May 23, 1995

[51] Int. Cl.[6] ..... B01F 5/08

[52] U.S. Cl. ..... 366/132; 137/505.22; 366/136; 366/176.2

[58] Field of Search ..... 366/176.1, 176.2, 366/336, 340, 341, 339, 131, 132, 136, 137; 137/505.22; 251/212

[56] References Cited

U.S. PATENT DOCUMENTS

| | | | |
|---|---|---|---|
| 3,762,435 | 10/1973 | Auverter | 137/505.22 |
| 4,127,332 | 11/1978 | Thiruvengadam | 366/131 |
| 4,493,558 | 1/1985 | Hudson | 366/341 |
| 4,506,991 | 3/1985 | Hudson | 366/341 |
| 4,580,904 | 4/1986 | Hacheney | 366/137 |
| 4,778,280 | 10/1988 | Brazelton | 366/136 |

*Primary Examiner*—Robert W. Jenkins
*Attorney, Agent, or Firm*—Thomas C. Saitta

[57] ABSTRACT

A homogenization apparatus for intermixing insoluble components, such as fuel oil and water, comprising a first compensating valve and homogenizing orifice where initial intermixing of the two components occurs, pump means, a high pressure chamber, and a second compensating valve and homogenizing orifice where secondary mixing occurs. The first compensating valve adjusts the first orifice responsive to downstream pressure, while the second compensating valve adjusts the second orifice responsive to upstream pressure.

22 Claims, 1 Drawing Sheet

FUEL HOMOGENIZATION SYSTEM WITH DUAL COMPENSATING HOMOGENIZATION VALVES

BACKGROUND OF THE INVENTION

The invention relates generally to the field of homogenization systems in which a first liquid or solid component, such as water or finely divided calcium based sorbants, is homogenized with a second liquid component, such as fuel oil, and more particularly to such systems where the homogenization is accomplished using orifices to produce shearing and cavitation. Even more particularly, the invention relates to such systems in which the homogenization orifice is a component of a compensating valve which is automatically responsive to pressure conditions either downstream or upstream of the orifice. Still even more particularly, the invention relates to such systems which incorporate two compensating valve homogenization orifices, the first responsive to downstream pressure relative to the first valve and the second responsive to upstream pressure relative to the second valve.

It is known that effective intermixing of additional components such as fresh water into a fuel oil stream which is subsequently burned to operate combustion systems such as large boilers or diesel engines is advantageous with regard to reducing fuel consumption, corrosion, particulate emissions, soot, and other pollutants. It is also known that addition of other additives to the base fuel oil, typically designated as a No. 6 fuel oil, such as a lower sulfur content fuel oil or powdered limestone, also improve the performance. For ease of discussion in this specification, reference herein shall focus on the water and fuel oil mix, but it is to be understood that the apparatus involved would be suitable for many mixtures or blends. The technique known as cavitation or cavitating flow is known in the art, see for example U.S. Pat. No. 4,127,332, in which a stream of a liquid component, such as fuel oil, is passed through a relatively small orifice at high velocity, resulting in a cavitating free turbulent velocity shear layer, and a second component insoluble in the first component, such as water, is added at the orifice exit in order to intermix the two components into a homogenized mixture or colloidal suspension. The cavitating free turbulent velocity shear layer creates a flow regime where vapor bubbles form, expand, contract and ultimately collapse. Under higher downstream pressure this collapse is relatively violent, which creates high pressure shock waves which cause intermittent intermixing of the components in the fuel stream cavitation zone, resulting in an homogenized fluid with long term stability or lack of separation.

Various factors such as volume, viscosity, upstream pressure, downstream or pump suction pressure, conduit diameter, orifice diameter, fuel temperature and changes in fuel temperature affect the amount of homogenization and the non-separation life of the fuel oil and water mixture. Control of the downstream pressure subsequent to the homogenization orifice has been found to be very important. The downstream pressure or pump suction pressure is directly affected by conditions at the homogenization orifice and by the aperture size in the orifice. Variations in temperature of the intermixing liquids, fluctuations in upstream pressure and erosion of the orifice over time can negatively affect the downstream pressure. For example, a single degree F change in temperature of the fuel can cause a 3 psig change in downstream pressure, and a single psig change in upstream pressure can cause a 0.6 psig change in downstream pressure. These factors can be critical in many systems, since a system with preferred downstream pressure of 30 psig should be maintained within a tolerance of 2 psig plus or minus. To account for these variables and to control the downstream pressure, I have previously developed a system, U.S. Pat. No. 4,493,558, in which the homogenizing orifice is part of a compensating valve whereby the orifice can be adjusted either manually, and where the orifice opening size is automatically adjustable responsive to the downstream pressure. In that patent, a compensating valve for controlling an adjustable orifice is disclosed which incorporates a hydraulic, diaphragm-type valve arranged in fluid communication with the downstream side of the system so as to be directly responsive to any changes in pressure on the downstream side of the orifice. A piston reciprocates the adjustable portion of the compensating valve to decrease the size of the orifice in response to an increase in downstream pressure and to increase the size of the orifice in response to a decrease in downstream pressure.

The present apparatus improves upon that system by providing a high pressure regime subsequent to the pump and a second homogenizing orifice coupled with an automatically responsive compensating valve. This second compensating valve is responsive to pressure in the high pressure regime upstream of the orifice, the valve and orifice acting to further intermix the homogenized fuel oil and water mix as well as to reduce the outlet pressure of the mixture to the desired range for optimum efficiency in the combustion equipment. This two stage cavitation process reduces water droplet size to 4 to 7 microns and breaks up all particles in the fuel oil to less than 10 microns diameter.

It is an object of this invention to provide an apparatus or system which effectively homogenizes a two liquid component stream of fuel oil and water while maintaining proper flow pressure. It is a further object to provide such a system where the homogenization is accomplished using the cavitation process of forcing a high pressure flow of liquid through a relatively small size orifice, where the variation in pressure downstream of the orifice is maintained within relatively precise limits. It is a still further object to provide such a system where the downstream pressure is maintained through the use of a compensating valve operating the adjustable orifice, the compensating valve being directly responsive to the pressure in a particular regime of the flow stream so as to immediately adjust the orifice to either increase or decrease flow and thereby increase or decrease downstream pressure as required. It is a still further object to provide such a system incorporating a pump and two homogenization orifices, one located upstream of the pump suction side and the other located downstream of the pump discharge side, where the pump creates a high pressure regime downstream on the discharge side and the first homogenization orifice is a operated by a first compensating valve responsive to pressure downstream of itself and the second homogenization orifice is operated by a second compensating valve responsive to pressure upstream of itself in the high pressure regime, the second orifice acting to significantly improve homogenization of the fuel oil and water mix.

SUMMARY OF THE INVENTION

The invention comprises a system or apparatus for homogenizing a mixture of two liquids or a mixture of liquids and solids where the components of the mixtures are insoluble with respect to each other, and in particular comprises a system or apparatus for homogenizing a mixture of fuel oil and water to be used in a combustion system, such as a boiler or diesel engine. The system comprises a pump and pump power means, such as an electric motor, to produce flow within the system, an inlet conduit or port for the first fluid, such as fuel oil, an inlet port or conduit for the second fluid, such as water, and a first homogenization orifice, whereby the fuel is forced through the first orifice at relatively high pressure to produce cavitation and the water is injected at the base of cavitation, such that homogenization of the fuel and water occurs within a first homogenization chamber. The first orifice is adjustable relative to opening size and is manipulated by a first compensating valve in response to downstream pressure within the first homogenization chamber or the suction side conduit, this pressure being sensed by a first pressure gauging means, such as a servomotor, and communicated through a first communicating means, such as a hydraulic fluid line, to control the first compensating valve, whereby an increase in pressure downstream of the first orifice results in a decrease in flow pressure through the first orifice, thereby reducing the pressure in the first homogenization chamber, and whereby a decrease in downstream pressure results in an increase in flow pressure through the first orifice, thereby increasing the pressure in the first homogenization chamber.

The homogenized fuel/water mixture then passes through the pump and exits through the pump discharge conduit into a high pressure chamber. The pressure of the homogenized fuel/water mixture in the high pressure chamber is significantly higher than the pressure allowable at the fuel/water mixture outlet port to the combustion system, the maximum pressure of which is determined by the operating parameters of the equipment utilizing the homogenized fuel/water mixture. The homogenized fuel/water mixture passes through a second homogenization orifice where mixing again occurs and into the second homogenization chamber at the much lower pressure required by the combustion system, before exiting through the outlet port into the combustion system utilizing the mixture. The second orifice is also adjustable relative to opening size and is manipulated by a second compensating valve in response to upstream pressure in the high pressure chamber, this pressure being sensed by a second pressure gauging means, such as a servomotor, and communicated through a second communicating means, such as a hydraulic fluid line, to control the second compensating valve, whereby an increase in pressure upstream of the second orifice results in an increase in flow pressure through the second orifice, thereby reducing the pressure in the high pressure chamber, and whereby a decrease in pressure in the high pressure chamber results in a decrease in flow pressure through the second orifice, thereby increasing the pressure in the high pressure chamber, such that a constant pressure within relatively limited tolerances is maintained in the high pressure chamber to insure that the pump is not damaged and that optimum secondary intermixing of the fuel/water mixture occurs in the second homogenization orifice. A recirculation conduit connects the outlet conduit back to the fuel inlet conduit preceding the first homogenization orifice to provide for continual operation of the homogenization system even when the combustion system is operating at low capacity or even turned off, such that a supply of homogenized fuel/water is always instantly available. Preferably there is also a pressure relief valve controlling a pressure relief conduit connecting the pump discharge conduit to the pump suction conduit as a fail-safe to protect the system.

In a typical application, the fuel homogenization system receives fuel oil from the combustion system within a 100 to 600 psig range in the fuel inlet conduit. After passage through the first homogenization orifice, the pressure within the first homogenization chamber and suction side conduit is typically within the range of 25 to 30 psig, and the pressure change in first homogenization chamber should be limited to plus or minus 2 psig. A pressure differential between the inlet conduit and the first homogenization chamber in the range of 10:1 is preferred for optimum cavitation effects. After discharge from the pump, the pressure in the high pressure chamber is preferably maintained in the range of 500 to 2000 psig. After passage through the second homogenization orifice, the pressure in the second homogenization chamber and the fuel/water mixture outlet conduit corresponds to the original inlet pressure in the range of 100 to 600 psig, the recirculation conduit serving to equalize the pressure in the inlet conduit and the outlet conduit, such that the pressure of the mixture through the outlet port is at the required combustion system pressure. Forcing the once-homogenized fuel/water mixture through the second homogenization orifice at pressures above 700 psig results in extremely efficient homogenization, mainly due to shear effects. The characteristics of the twice-homogenized fuel/water mixture in the second homogenization chamber are greatly improved relative to the characteristics of the mixture in the first homogenization chamber, with water droplet size being reduced to the range of 4 to 7 microns and particle size of the fuel being reduced to less than 10 microns.

DETAILED DESCRIPTION OF THE INVENTION

Figure 1:
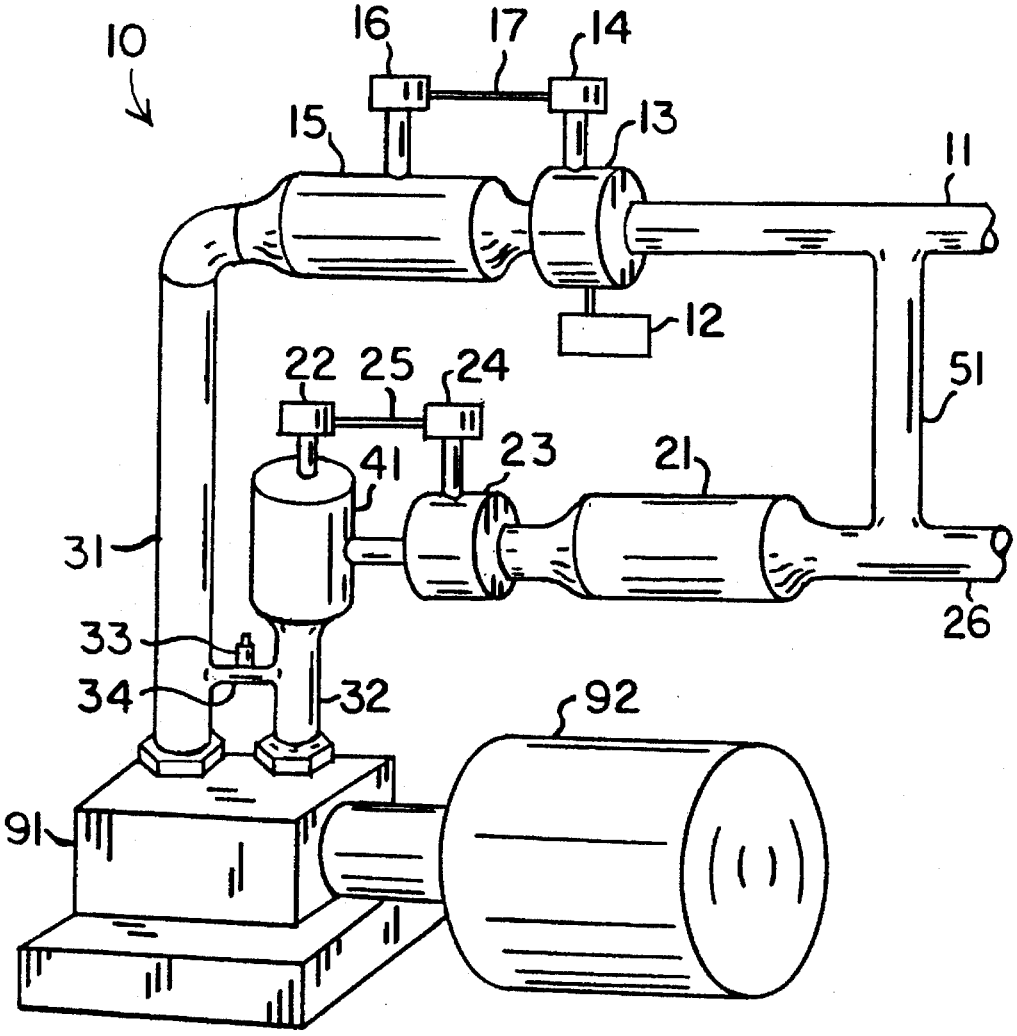
FIG. 1 is a view of the component elements of the system.

With reference now to the drawing, the invention will now be described in detail with respect to the preferred embodiment and best mode. The homogenization system with dual compensating valves is primarily designed for application with fuel homogenization, and in particular homogenization of heavy grade fuels for combustion such as fuel oil with water added as an insoluble component to improve combustion characteristics, and reference in this disclosure will be made to fuel oil and water mixtures without intent to limit the scope of the invention, as it is to be understood that the system can be used with many liquids and liquid or solid additives requiring homogenized mixing of all the components. The system is constructed to be incorporated into the fuel supply line of a combustion equipment system, such as a boiler or internal combustion engine, either as a built-in part of the fuel supply system or as an add-on where the fuel flow is diverted from the fuel supply line into the invention, homogenization is achieved, and the fuel delivered back into the fuel supply line for combustion in the boiler or engine.

As shown in FIG. 1, the invention is a system capable of conducting liquid components comprising in general a first component or fuel inlet conduit or port 11 to receive fuel from the fuel supply line of the combustion equipment system, a second component or water inlet conduit or port 12, pumping means 91 to circulate the liquid through the fuel homogenization system, and a fuel/water outlet conduit 26 for delivering the homogenized mixture back to the fuel supply line of the combustion equipment system at the proper pressure. A first homogenization of the fuel and water mixture occurs upstream or on the suction side of the pump 91 and a second homogenization occurs downstream or on the discharge side of the pump 91. Pumping means 91 may be of any suitable type capable of transporting the liquids under the required conditions and capable of producing a high pressure regime within desired ranges on the discharge side. Pumping means 91 may be powered by any suitable pump power means 92, such as an electric motor or the like.

Fuel is brought into the system from the fuel supply line through inlet conduit 11, which may comprise any suitable conduit and fitting required to join the invention to the fuel supply line, and delivered into the first compensating valve 14. The fuel is brought into the system at the pressure normally present in the supply fuel line, typically in the range of between 100 to 600 psig. First compensating valve 14 comprises an adjustable first homogenization orifice 13, the compensating valve 14 acting to change the size of the first homogenization orifice 13 in response to communication from a first pressure gauging means 16 which senses pressure in a first homogenization chamber 15 downstream of the first homogenization orifice 13. The first homogenization orifice 13 is a relatively small, adjustable opening in the fuel flow path with relatively sharp edges and corners which provides a cavitating free turbulent velocity shear layer which creates a flow regime on the exit side of the orifice in which vapor bubbles form, expand, contract and collapse. A representative example of a suitable type of homogenization orifice 13 can be found in my U.S. Pat. Nos. 4,493,558 and 4,506,991, and other types of homogenization orifices are known in the art. A second component, such as water or an insoluble solid, is added to the flow regime at the exit of the homogenization orifice 13 through water inlet port 12 in first homogenization valve 14. Immediately downstream of the first homogenization orifice 13 and valve 14 is the first homogenization chamber 15, which is maintained at a much lower pressure than the inlet conduit 11. The pressure differential between the fuel inlet conduit 11 and the first homogenization chamber 15 is preferably in the range of 10:1, such that an inlet pressure of 300 psig drops to 30 psig in the first homogenization chamber 15. Because of the low pressure in the first homogenization chamber 15, the water can be added to the fuel at low pressure without need to incorporate high pressure injection means, as would be required if the addition of the water were to occur prior to the first homogenization orifice 13. The fuel and water is efficiently homogenized due to the cavitation effects, as is more fully described in U.S. Pat. No. 4,493,558, herein incorporated by reference.

It is preferred to maintain the pressure within the first homogenization chamber 15 and the suction pressure of the pumping means 91 within relatively narrow parameters to insure maximum homogenization of the fuel and water. For example, for a system where 30 psig is the optimum pressure in the first homogenization chamber 15, a tolerance within plus or minus 2 psig is preferred, as pressures above or below the optimum pressure result in less efficient mixing of the components. In order to maintain the pressure in the first homogenization chamber 15 within these limits, it is necessary to monitor the pressure of the fuel/water mix within the first homogenization chamber 15, since pressure fluctuations can occur due to changes in fuel supply pressure, flow, temperature, etc. A first pressure gauging means 16 is connected to the first homogenization chamber 15 to sense the pressure and communicate the pressure changes through first communicating means 17 to the first compensating valve 14 operating the adjustable first homogenizing orifice 13. While the pressure gauging means 16 and communicating means 17 can be of any known type suitable of sensing the pressure changes and relaying the information to the first compensating valve 14, such as pneumatics or electronics, it is preferred that hydraulic components be utilized, such as a servomotor and hydraulic fluid conduit connected directly to the first compensating valve 14, as this is a relatively simple set of components but is highly reliable and provides instantaneous adjustment of the first homogenizing orifice 13. In operation, the homogenizing orifice 13 is adjusted such that the opening is reduced in size in response to a rise in pressure in the first homogenization chamber 15, thereby restricting fuel flow and reducing the pressure in the homogenization chamber 15, and such that the opening is increased in response to a drop in pressure in the first homogenization chamber 15, thereby increasing flow and raising the pressure.

The once-homogenized fuel/water mixture is pulled through the suction side conduit 31 into the pumping means 91 and discharged into the discharge side conduit 32 which connects to the high pressure chamber 41. Preferably, a pressure relief conduit 34 and pressure relief valve 33, of any known type with suitable volume for release of pressure should it exceed critical system limits, connects the discharge side conduit 32 to the suction side conduit 31. The high pressure chamber 41 is constructed to allow for a large increase in pressure of the once-homogenized fuel/water mix on the discharge side of the pumping means 91. The pressure of the once-homogenized fuel/water mix in the high pressure chamber 41 is increased to a range from 500 to 2000 psig depending on the capabilities and system design of pumping means 91 by restricting flow from the high pressure chamber 41 by second compensating valve 24.

The once-homogenized fuel/water mixture is placed under high pressure to allow for a second homogenization process. While the first homogenization results in a very stable mixture with small droplet size, it has been found that incorporating a second homogenization prior to reintroducing the fuel/water mixture into the fuel supply line of the combustion equipment system dramatically improves the desired homogenization characteristics of the mixture. A second compensating valve 24 operating a second homogenization orifice 23 is positioned downstream of the high pressure chamber 41, with the second homogenization orifice 23 opening into a second homogenization chamber 21. The pressure in the second homogenization chamber 21 is a function of and corresponds to the required pressure of the combustion equipment system, such that the pressure in the outlet conduit 26 communicating with the second homogenization chamber 21 and delivering the homogenized fuel/water mixture to the combustion equipment system should match the pressure of the fuel in the inlet conduit 11, typically in the range of from 100 to 600 psig. The second homogenization orifice 23 is a relatively small, adjustable opening having sharp edges and corners whereby the shear flow effects of the fuel/water mixing passing from the high pressure regime to the lower pressure regime further homogenize the mixture and reduce droplet size. To a lesser degree, cavitation effects also further homogenize the mixture, but these effects are limited because the pressure differential between the high pressure chamber 41 and the second homogenization chamber 21 is not as great as in the first homogenization regime. It has been determined that droplet size of the water is reduced to the range of 4 to 7 microns and particle size of the fuel is reduced to less than 10 microns in the second homogenization regime with a pressure drop from greater than 700 psig down to 300 psig.

In order to maintain the system in continual operation and to protect the pumping means 91 from failure due to over-pressurization, it is necessary to monitor the pressure in the high pressure chamber 41 to insure that the pressure is kept below a predetermined maximum. Likewise, it is preferable to maintain the pressure within the high pressure chamber 41 and the discharge side of the pumping means 91 at a relative high constant value to maximize homogenization. Therefore, a second pressure gauging means 22 is connected to sense the pressure within the high pressure chamber 41 and relay any changes to the second compensating valve 24 through second communicating means 25. As with first pressure gauging means 16 and first communicating means 17, any known device capable of sensing the pressure change in the high pressure chamber 41 and relaying the information to the second compensating valve 24 may be utilized, but a hydraulic system incorporating a servomotor and hydraulic fluid conduit line directly connected to the second compensating valve 24 is preferred for instantaneous response and reliability. Second compensating valve 24 operates second homogenizing orifice 23 in response to pressure upstream of that orifice and in opposite manner to first compensating valve 14 and first compensating orifice 13, such that an increase in pressure in the high pressure chamber 41 results in an increase in the opening size of second homogenizing orifice 23, thus increasing the flow of the homogenized fuel/water mixture into the second homogenization chamber 21 and reducing the pressure in the high pressure chamber 41 to protect the pumping means 91, while a drop in pressure in high pressure chamber 41 results in a decrease in opening size of second homogenization orifice 23, thereby decreasing homogenized fuel/water flow into the second homogenization chamber 21 and raising the pressure in the high pressure chamber 41 back to the optimum value.

A recirculation conduit 51 connects the inlet conduit 11 to the outlet conduit 26 and acts to stabilize and equalize the pressure of the liquids in the inlet conduit 11 and outlet conduit 26. The recirculation conduit 51 additionally allows continual operation of the homogenization system such that a ready supply of homogenized fuel/water is retained in the system when the fuel supply from the fuel supply line of the combustion equipment system is either stopped or lessened, as would occur if the combustion equipment system operates intermittently rather than continually, and is immediately available to the combustion equipment system upon demand. The volume of the homogenization system is preferably 120 percent of the maximum capacity of the combustion system to maintain a constant fuel/water homogenization at a firing range of from 0 to maximum combustion system design. Moreover, the recirculation conduit 51 provides for a fail-safe flow to the combustion system should the pumping means 91 or pump power means 92 fail.

It is understood that equivalents and substitutions may be obvious to those skilled in the art, and therefore the true scope and definition of the invention is to be as set forth in the following claims.

I claim:

1. A homogenization apparatus for homogeneously intermixing insoluble components comprising:

(A) a first component inlet conduit for supplying a first component to the apparatus;

(B) a second component inlet conduit supplying a second component to the apparatus;

(c) a first homogenization orifice for intermixing said first component and said second component;

(D) pump means to move said first and second components through said apparatus;

(E) a high pressure chamber to receive said intermixed first and second components at an elevated pressure;

(F) a second homogenization orifice for further intermixing said first and second components:

(G) an outlet conduit for removing said intermixed first and second components from said apparatus;

(H) conduit means for fluidly connecting said first component inlet conduit, said second component inlet conduit, said first homogenization orifice, said pump means, said high pressure chamber, said second homogenization orifice, and said outlet conduit.

2. The apparatus of claim 1, further comprising a first compensating valve for adjusting said first homogenization orifice and a second compensating valve for adjusting said second homogenization orifice.

3. The apparatus of claim 2, further comprising a first pressure gauging means to sense pressure downstream of said first homogenization orifice and first communication means to communicate pressure changes to said first compensating valve; and a second pressure gauging means to sense pressure upstream of said second homogenization orifice and second communication means to communicate pressure changes to said second compensating valve.

4. The apparatus of claim 3, further comprising a recirculation conduit to recycle said intermixed first and second component from said second homogenization orifice back to said first homogenization orifice.

5. The apparatus of claim 3, where said first and second pressure gauging means, said first and second communicating means, and said first and second compensating valves operate hydraulically.

6. The apparatus of claim 3, further comprising a first homogenization chamber downstream of said first homogenization orifice, whereby the combination of said first homogenization chamber and said first homogenization orifice results in a significant decrease in pressure downstream of said first homogenization orifice; and further comprising a second homogenization chamber downstream of said second homogenization orifice, whereby the combination of said second homogenization chamber and said second homogenization orifice results in a significant decrease in pressure downstream of said second homogenization orifice.

7. The apparatus of claim 6, where the ratio of pressure upstream of said first homogenization orifice to said pressure downstream of said first homogenization orifice is 10:1.

8. The apparatus of claim 6, where said pressure of said intermixed first and second component within said high pressure chamber is at least 700 psig.

9. A homogenization apparatus for homogeneously intermixing insoluble components comprising:

(A) a first component inlet conduit for supplying a first component to the apparatus;

(B) a second component inlet conduit supplying a second component to the apparatus;

(C) a first homogenization orifice for intermixing said first component and said second component from said first component inlet conduit and said second component inlet conduit;

(D) pump means to move said first and second components through said apparatus, said pump means comprising a suction side to draw said intermixed first and second components from said first homogenization orifice and a discharge side to deliver said intermixed first and second components to a high pressure chamber;

(E) a high pressure chamber to receive said intermixed first and second components from said discharge side of said pump means adapted to contain said intermixed first and second components at an elevated pressure;

(F) a second homogenization orifice to receive said intermixed first and second components from said high pressure chamber and for further intermixing said first and second components;

(G) an outlet conduit for removing said intermixed first and second components from said apparatus;

(H) conduit means for fluidly connecting said first component inlet conduit, said second component inlet conduit, said first homogenization orifice, said pump means, said high pressure chamber, said second homogenization orifice, and said outlet conduit.

10. The apparatus of claim 9, further comprising a first compensating valve for adjusting said first homogenization orifice and a second compensating valve for adjusting said second homogenization or if ice.

11. The apparatus of claim 10, further comprising a first pressure gauging means to sense pressure downstream of said first homogenization orifice and first communication means to communicate pressure changes to said first compensating valve; and a second pressure gauging means to sense pressure upstream of said second homogenization orifice and second communication means to communicate pressure changes to said second compensating valve.

12. The apparatus of claim 11, further comprising a first homogenization chamber downstream of said first homogenization orifice, whereby the combination of said first homogenization chamber and said first homogenization orifice results in a significant decrease in pressure downstream of said first homogenization orifice; and further comprising a second homogenization chamber downstream of said second homogenization orifice, whereby the combination of said second homogenization chamber and said second homogenization orifice results in a significant decrease in pressure downstream of said second homogenization orifice.

13. The apparatus of claim 12, where the ratio of pressure upstream of said first homogenization orifice to said pressure downstream of said first homogenization orifice is 10:1.

14. The apparatus of claim 12, where said pressure of said intermixed first and second component within said high pressure chamber is at least 700 psig.

15. The apparatus of claim 11, further comprising a recirculation conduit to recycle said intermixed first and second component from said second homogenization orifice back to said first homogenization orifice.

16. The apparatus of claim 11, where said first and second pressure gauging means, said first and second communicating means, and said first and second compensating valves operate hydraulically.

17. A homogenization apparatus for homogeneously intermixing insoluble components comprising:

(A) a first component inlet conduit for supplying a first component to the apparatus;

(B) a second component inlet conduit supplying a second component to the apparatus;

(C) a first compensating valve comprising an adjustable first homogenization orifice for controlling flow rate and intermixing said first component and said second component from said first component inlet conduit and said second component inlet conduit;

(D) a first pressure gauging means for sensing the pressure downstream of said first compensating valve and communicating changes in pressure to said first compensating valve, whereby said first compensating valve adjusts said first homogenization orifice in response to said changes in pressure to adjust the flow rate and maintain a generally constant pressure downstream of said first compensating valve;

(E) pump means to move said first and second components through said apparatus, said pump means comprising a suction side to draw said intermixed first and second components from said first homogenization orifice and a discharge side to deliver said intermixed first and second components to a high pressure chamber;

(F) a high pressure chamber to receive said intermixed first and second components from said discharge side of said pump means adapted to contain said intermixed first and second components at an elevated pressure;

(G) a second compensating valve comprising an adjustable second homogenization orifice for controlling flow rate and receiving said intermixed first and second components from said high pressure chamber and for further intermixing said first and second components;

(H) a second pressure gauging means for sensing the pressure upstream of said second compensating valve and communicating changes in pressure to said second compensating valve, whereby said second compensating valve adjusts said second homogenization orifice in response to said changes in pressure to adjust flow rate and maintain a generally constant pressure upstream of said second compensating valve;

(I) an outlet conduit for removing said intermixed first and second components from said apparatus;

(J) conduit means for fluidly connecting said first component inlet conduit, said second component inlet conduit, said first compensating valve, said pump means, said high pressure chamber, said second compensating valve, and said outlet conduit.

18. The apparatus of claim 17, further comprising a first homogenization chamber downstream of said first homogenization orifice, whereby the combination of said first homogenization chamber and said first homogenization orifice results in a significant decrease in pressure downstream of said first homogenization orifice; and further comprising a second homogenization chamber downstream of said second homogenization orifice, whereby the combination of said second homogenization chamber and said second homogenization orifice results in a significant decrease in pressure downstream of said second homogenization orifice.

19. The apparatus of claim 18, where the ratio of pressure upstream of said first homogenization orifice to said pressure downstream of said first homogenization orifice is 10:1.

20. The apparatus of claim 18, where said pressure of said intermixed first and second component within said high pressure chamber is at least 700 psig.

21. The apparatus of claim 17, where said first and second pressure gauging means, said first and second communicating means, and said first and second compensating valves operate hydraulically.

22. The apparatus of claim 17, further comprising a recirculation conduit to recycle said intermixed first and second component from said second homogenization orifice back to said first homogenization orifice.

* * * * *